US009368911B2

(12) United States Patent
Charnesky et al.

(10) Patent No.: US 9,368,911 B2
(45) Date of Patent: Jun. 14, 2016

(54) SYSTEMS AND METHODS FOR SELF-CLOSING ELECTRICAL CONNECTOR

(71) Applicant: GM GLOBAL TECHNOLOGY OPERATIONS LLC, Detroit, MI (US)

(72) Inventors: Scott P. Charnesky, Dardene Prairie, MO (US); Khanh V. Hoang, Wentzville, MO (US); Jeffrey L. Konchan, Romeo, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/542,154

(22) Filed: Nov. 14, 2014

(65) Prior Publication Data

US 2016/0141800 A1 May 19, 2016

(51) Int. Cl.

| | |
|---|---|
| ***H01R 11/22*** | (2006.01) |
| ***H01R 13/639*** | (2006.01) |
| *H01R 13/622* | (2006.01) |
| *H01R 13/627* | (2006.01) |
| *H01R 13/533* | (2006.01) |
| *H01R 13/623* | (2006.01) |

(52) U.S. Cl.

CPC ..... *H01R 13/639* (2013.01); *H01R 13/533* (2013.01); *H01R 13/622* (2013.01); *H01R 13/623* (2013.01); *H01R 13/627* (2013.01)

(58) Field of Classification Search

CPC .. H01R 13/622; H01R 13/623; H01R 13/627; H01R 13/639; H01R 13/533

USPC ..... 439/312, 848, 838, 836, 832, 717, 594, 439/307, 301

See application file for complete search history.

(56) References Cited

U.S. PATENT DOCUMENTS

| | | | | |
|---|---|---|---|---|
| 4,530,559 | A | 7/1985 | Burns et al. | |
| 5,217,384 | A | 6/1993 | Merten et al. | |
| 5,531,605 | A * | 7/1996 | Taniuchi | H01R 13/62933 439/157 |
| 6,325,648 | B1 * | 12/2001 | Bilezikjian | H01R 13/62938 439/157 |
| 6,390,843 | B1 | 5/2002 | Lim | |
| 6,554,626 | B2 | 4/2003 | Ramos | |
| 7,097,514 | B2 | 8/2006 | Ishizaki et al. | |
| 7,186,130 | B1 | 3/2007 | Miller | |
| 7,306,472 | B2 | 12/2007 | Matsumoto et al. | |

(Continued)

OTHER PUBLICATIONS

USPTO, Notice of Allowance for U.S. Appl. No. 13/954,440, mailed Aug. 25, 2015.

(Continued)

*Primary Examiner* — Hae Moon Hyeon
*Assistant Examiner* — Peter G Leigh
(74) *Attorney, Agent, or Firm* — Ingrassia Fisher & Lorenz, P.C.

(57) ABSTRACT

Methods and apparatus are provided for an electrical connector. In one embodiment, an electrical connector system is provided. The electrical connector system includes a first electrical connector portion and a second electrical connector portion defining a cavity to receive the first electrical connector portion. The electrical connector system also includes a locking system coupled to the first electrical connector portion. The locking system includes a biasing member and at least one locking arm. The biasing member is coupled to the at least one locking arm and the biasing member is movable from a first position to a second position. A force required to move the biasing member from the first position to the second position diminishes as the biasing member moves from the first position to the second position.

17 Claims, 10 Drawing Sheets

(56) References Cited

U.S. PATENT DOCUMENTS

| | | | | |
|---|---|---|---|---|
| 7,452,233 | B1 | 11/2008 | Michelsen | |
| 7,497,721 | B2 | 3/2009 | Lauermann et al. | |
| 7,744,400 | B2 | 6/2010 | Carmitchel | |
| 7,758,370 | B1 | 7/2010 | Flaherty | |
| 7,758,371 | B2 | 7/2010 | Carmitchel | |
| 7,811,115 | B1 | 10/2010 | Tyler | |
| 8,052,458 | B2 | 11/2011 | Rossman et al. | |
| 8,206,170 | B2 | 6/2012 | Matsumoto et al. | |
| 8,328,574 | B1 | 12/2012 | Lin | |
| 8,357,005 | B2 | 1/2013 | Hu | |
| 8,376,767 | B2 | 2/2013 | Kahara et al. | |
| 8,480,424 | B2 | 7/2013 | Koellmann | |
| 8,632,353 | B2 | 1/2014 | Rassoolkhani | |
| 8,690,596 | B2 | 4/2014 | Su et al. | |
| 8,696,373 | B2 * | 4/2014 | Yagome | H01R 13/62955 439/310 |
| 8,784,126 | B2 | 7/2014 | Chang | |
| 8,787,025 | B2 | 7/2014 | Wu | |
| 8,911,245 | B2 * | 12/2014 | Okamoto | H01R 13/62944 439/157 |
| 9,130,324 | B2 * | 9/2015 | Furuya | H01R 24/005 |
| 2008/0132098 | A1 * | 6/2008 | Tyler | H01R 13/62977 439/157 |
| 2009/0246991 | A1 * | 10/2009 | Shuey | H01R 13/62955 439/157 |
| 2010/0120284 | A1 * | 5/2010 | Oka | H01R 13/44 439/372 |
| 2010/0227494 | A1 * | 9/2010 | Tyler | H01R 13/62977 439/372 |
| 2011/0189883 | A1 * | 8/2011 | Suzuki | H01R 13/62 439/372 |
| 2014/0256169 | A1 * | 9/2014 | Suzuki | H01R 13/62955 439/312 |
| 2015/0037999 | A1 | 2/2015 | Konchan et al. | |

OTHER PUBLICATIONS

USPTO, Final Office Action for U.S. Appl. No. 13/954,440, mailed May 8, 2015.

USPTO, Office Action for U.S. Appl. No. 13/954,440, mailed Feb. 5, 2015.

* cited by examiner

SYSTEMS AND METHODS FOR SELF-CLOSING ELECTRICAL CONNECTOR

TECHNICAL FIELD

The present disclosure generally relates to electrical connectors and more particularly relates to systems and methods for a self-closing electrical connector with a tactile locking feature.

BACKGROUND

Generally, electrical connector systems are used in a variety of industries to electrically interconnect components. In one example, an electrical connector system can comprise a male portion and a female portion, which form an electrical connection when coupled together. Typically, the electrical connector system includes a mechanism to electrically couple the male portion with the female portion. In certain instances, it may be difficult to confirm that a male portion is properly electrically coupled with a female portion, due to visibility, etc. In addition, in certain instances, while the male portion and female portion may appear properly electrically coupled, after a period of time, the male portion and female portion may become unsecured to each other.

Accordingly, it is desirable to provide improved systems and methods for a self-closing electrical connector with a tactile locking feature. Furthermore, other desirable features and characteristics of the present invention will become apparent from the subsequent detailed description and the appended claims, taken in conjunction with the accompanying drawings and the foregoing technical field and background.

SUMMARY

In one embodiment, an electrical connector system is provided. The electrical connector system comprises a first electrical connector portion and a second electrical connector portion defining a cavity to receive the first electrical connector portion. The electrical connector system also comprises a locking system coupled to the first electrical connector portion. The locking system includes a biasing member and at least one locking arm. The biasing member is coupled to the at least one locking arm and the biasing member is movable from a first position to a second position. A force required to move the biasing member from the first position to the second position diminishes as the biasing member moves from the first position to the second position.

In one embodiment, an electrical connector system is provided. The electrical connector system comprises a first electrical connector portion having a first side and a second electrical connector portion defining a cavity to receive the first electrical connector portion. The second electrical connector portion includes a second side, with a pin extending outwardly from the second side. The electrical connector system also comprises a locking system coupled to the first side of the first electrical connector portion. The locking system includes a biasing member and at least one locking arm. The biasing member is coupled to the at least one locking arm and the biasing member is movable from a first position to a second position. The movement of the biasing member from the first position to the second position engages the at least one locking arm with the pin of the second electrical connector portion to electrically couple the first electrical connector portion to the second electrical connector portion.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Figure 1:
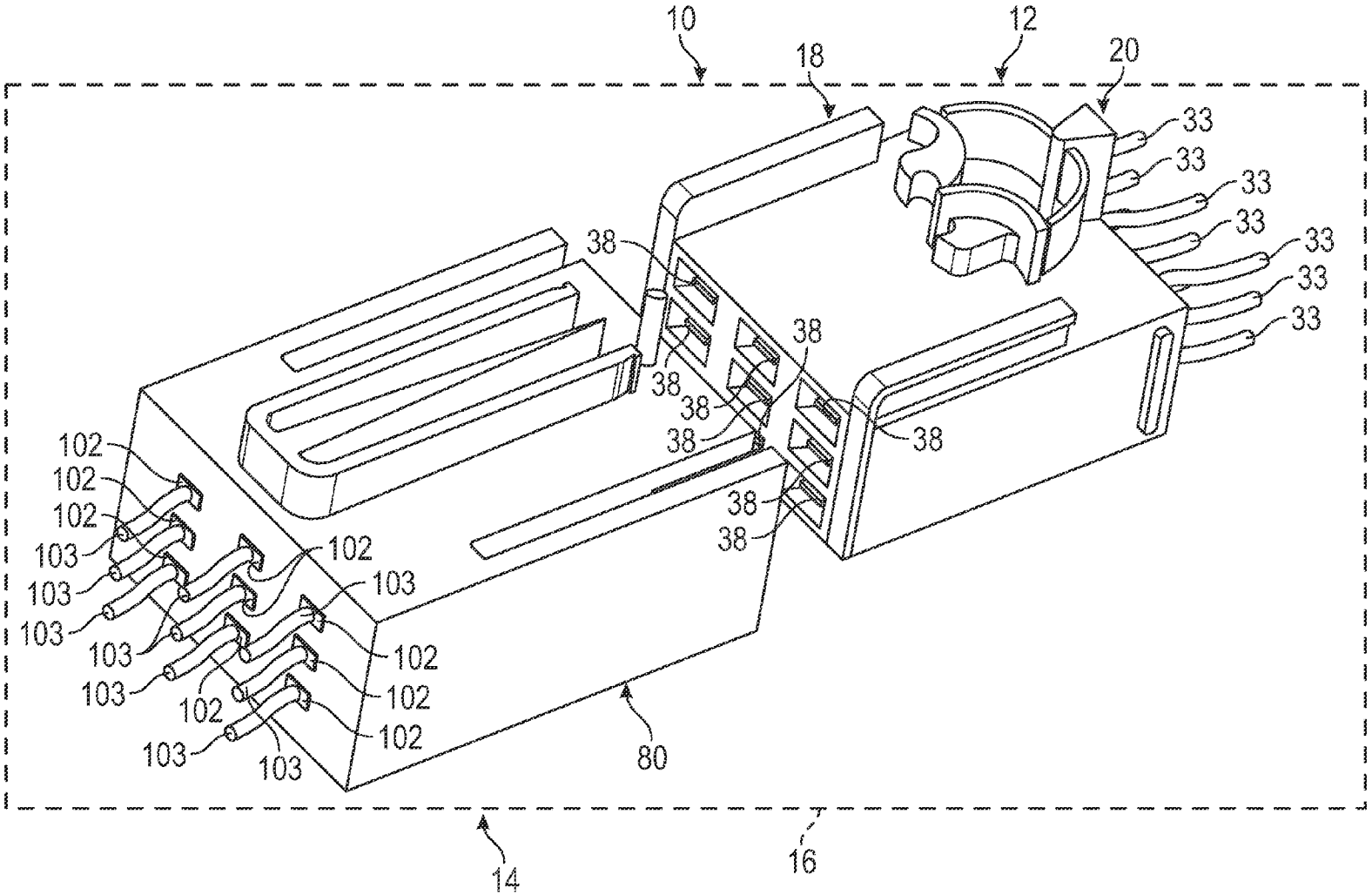
FIG. 1 is a perspective view illustrating an electrical connector system in accordance with the various teachings of the present disclosure.
Figure 2:
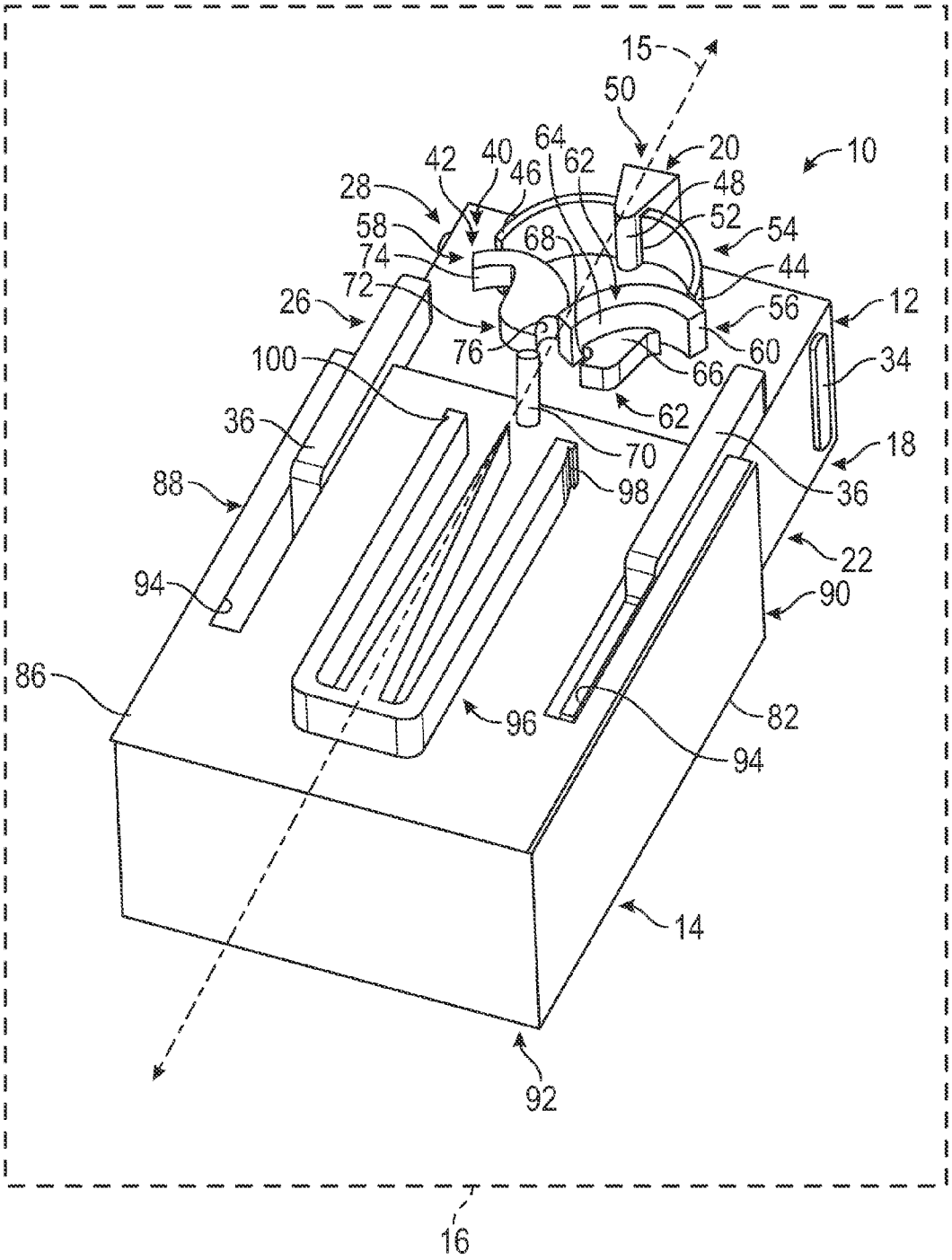
FIG. 2 is a perspective schematic view illustrating an electrical connector system in accordance with the various teachings of the present disclosure.

With reference to FIGS. 1 and 2, an electrical connector system 10 is shown. The electrical connector system 10 includes a first or male connector portion 12 and a second or female connector portion 14, which can each extend along a longitudinal axis 15 (FIG. 2). The male connector portion 12 and the female connector portion 14 can be used to electrically interconnect any suitable electrical device, component or wiring as known to those skilled in the art. As a further example, the electrical connector system 10 can be used on a vehicle 16, such as a motor vehicle, to interconnect one or more electrical devices. For clarity, the male connector portion 12 and the female connector portion 14 are illustrated without the associated wiring and electrical contacts in FIGS.

2-10, with the understanding that the male connector portion 12 and the female connector portion 14 include associated wiring and electrical contacts as illustrated in FIG. 1.

Figure 3:
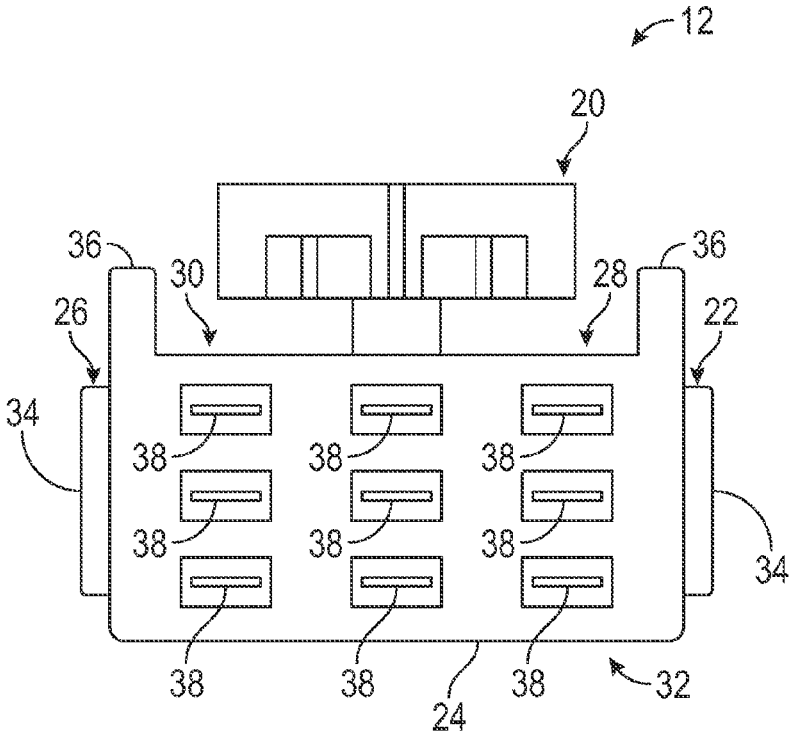
FIG. 3 is an end view of a male connector portion of the electrical connector system of FIG. 2.
Figure 4:
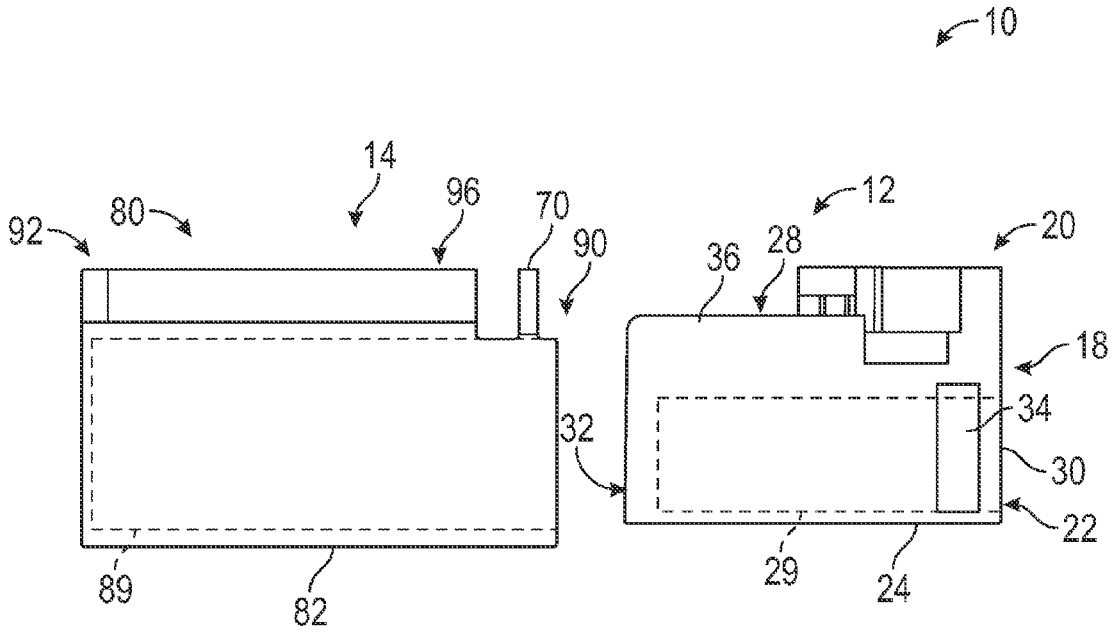
FIG. 4 is an exploded side view of the electrical connector system of FIG. 2.

With continued reference to FIG. 2, and with additional reference to FIGS. 3 and 4, the male connector portion 12 includes a housing 18 and a locking system 20. In one example, the housing 18 can be substantially rectangular, however, the housing 18 can have any desired shape. The housing 18 includes a first side 22, a second side 24, a third side 26 and a fourth side 28. The first side 22, second side 24, third side 26 and fourth side 28 cooperate to define a cavity 29 (FIG. 4). The housing 18 also includes a first end 30 and a second end 32. In one example, the housing 18 is composed of a polymeric material.

Figure 9:
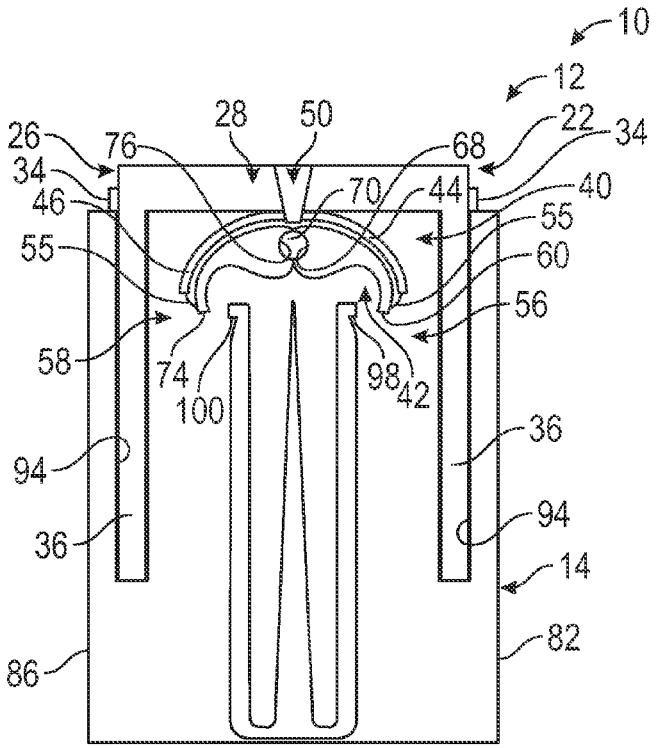
FIG. 9 is a front view of the electrical connector system of FIG. 2, in which the locking system of the male connector portion is in a second position.

As best shown in FIG. 3, the first side 22 is generally opposite the third side 26. The first side 22 and the third side 26 each include a projection 34, which abuts the female connector portion 14 when the male connector portion 12 is fully coupled to the female connector portion 14 (FIG. 9). The second side 24 is generally opposite the fourth side 28. The second side 24 is substantially planar, to facilitate receipt of the male connector portion 12 into the female connector portion 14. The fourth side 28 includes at least one guide 36 and the locking system 20. In one example, the at least one guide 36 comprises a plurality of guides 36, which extend outwardly or away from the fourth side 28, in a direction substantially perpendicular to a plane defined by the fourth side 28. In this example, the guides 36 extend from an area adjacent to the first end 30 to the second end 32. The guides 36 assist in aligning the male connector portion 12 with the female connector portion 14. As will be discussed further herein, the locking system 20 is coupled to the fourth side 28 at the first end 30. The locking system 20 is coupled to the fourth side 28 so as to extend outwardly or away from the fourth side 28. Generally, the locking system 20 extends outwardly for a greater distance than the guides 36, as illustrated in FIG. 3.

The cavity 29 is generally defined through the housing 18 from the first end 30 to the second end 32. With reference to FIG. 1, the cavity 29 enables the passage of at least one or a plurality of conductors 33 from one or more contacts 38 through the housing 18. In one example, the second end 32 defines at least one or a plurality of contacts 38, to which the one or more conductors are electrically coupled.

The locking system 20 is coupled at the first end 30, and extends outwardly from the fourth side 28. The locking system 20 comprises a self-closing locking system, which provides an operator assembling the male connector portion 12 with the female connector portion 14 a tactile feedback that the male connector portion 12 is coupled, locked or secured, and electrically connected to the female connector portion 14. In one example, with reference to FIG. 2, the locking system 20 includes at least one biasing member 40 and at least one locking arm 42. In this example, the locking system 20 includes a single biasing member 40, however, the biasing member 40 can be composed of two separate and discrete biasing members, if desired.

The biasing member 40 is an over-center type biasing member. In this regard, the biasing member 40 has a first use position, and once moved past a peak, threshold or "over-center", the biasing member 40 moves or conforms into a second use position. Stated another way, the biasing member 40 stores energy input to the biasing member 40 to move the biasing member 40 from the first position to the second position, and once the biasing member 40 has moved past the peak or threshold, the energy stored by the biasing member 40 is used to move the biasing member 40 into the second position without further external input. In other words, once the biasing member 40 has been moved past the peak or threshold position, the biasing member 40 substantially automatically moves itself into the second position. Thus, while a first force is required to move the biasing member 40 from the first position to the peak position, a second, different force is required to move the biasing member 40 from the peak position to the second position. Typically, the second force is less than the first force. In this example, an increasing amount of force is required to move the biasing member 40 from the first position to the peak position. Thus, once at the peak position, the amount of force required from an operator is greatly reduced as the biasing member 40 substantially automatically moves from the peak position to the second position, thereby providing a tactile, and in certain cases, visual feedback to the operator that the locking system 20 has secured and electrically connected the male connector portion 12 to the female connector portion 14.

In one example, the biasing member 40 comprises a leaf spring, however, any suitable biasing member, over-center device or energy storing member can be employed. The biasing member 40 is composed of a polymeric material, however, the biasing member 40 can be composed of a flexible metal or metal alloy, including, but not limited to aluminum, for example. Generally, the biasing member 40 is substantially C-shaped, and includes a first end 44 and a second end 46. The biasing member 40 is coupled to the male connector portion 12 at a center point 48 of the biasing member 40. The biasing member 40 is coupled to the male connector portion 12 such that the first end 44 and the second end 46 of the biasing member 40 are movable relative to the center point 48. In one example, the biasing member 40 is coupled to the male connector portion 12 via a post 50. In this example, the post 50 defines a slot 52, through which the biasing member 40 is received. Generally, the slot 52 is defined such that the biasing member 40 is supported in the slot 52 by a portion 54 of the post 50. It should be noted, however, that the biasing member 40 can be supported on the male connector portion 12 in alternative ways, such as through the use of mechanical fasteners, for example. Thus, the post 50 illustrated herein is merely exemplary.

Figure 5:
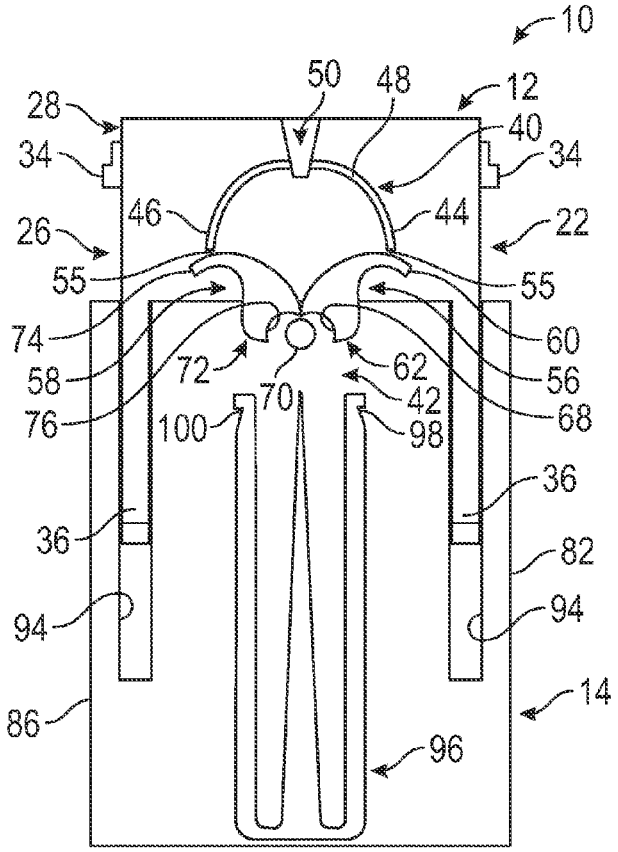
FIG. 5 is a front view of the electrical connector system of FIG. 2, in which a locking system of the male connector portion is in a first position.

The first end 44 and the second end 46 of the biasing member 40 are movable relative to the center point 48 to enable the biasing member 40 to move between the first position and the second position. As best shown in FIG. 5, the first end 44 and the second end 46 are each coupled to the at least one locking arm 42 via a web 55.

In this regard, in this example, the at least one locking arm 42 comprises a first locking arm 56 and a second locking arm 58. It should be noted that the locking system 20 illustrated herein is merely exemplary, as a larger locking system or smaller locking system (e.g. one locking arm 42 with one biasing member 40) can be employed depending upon the size (e.g. number of electrical contacts) of the male connector portion 12 and the female connector portion 14. The first locking arm 56 and the second locking arm 58 can be composed of a polymeric material, however, the first locking arm 56 and second locking arm 58 can be composed of a suitable metal or metal alloy if desired. The first locking arm 56 is coupled to the first end 44 and the second locking arm 58 is coupled to the second end 46 of the biasing member 40 via a respective web 55. Thus, as will be discussed further herein, movement of the first end 44 and second end 46 of the biasing member 40 causes the first locking arm 56 and second locking arm 58 to move.

With reference to FIG. 2, the first locking arm 56 has a locking end 60 and a receiving end 62. The first locking arm 56 can also define a flange 64 from the locking end 60 to the receiving end 62. In one example, the flange 64 is arcuate or curved, and extends outwardly from a body 66 of the first locking arm 56. The locking end 60 engages a portion of the female connector portion 14 to couple the male connector portion 12 to the female connector portion 14. The locking end 60 is substantially arcuate or rounded, however, the locking end 60 can have any desired shape to engage the female connector portion 14.

The receiving end 62 defines an aperture 68. The aperture 68 is semi-circular to engage a pin 70 of the female connector portion 14. While the aperture 68 is illustrated herein as being semi-circular and the pin 70 as cylindrical, the aperture 68 and the pin 70 can have any desired cooperating shape. The receiving end 62 of the first locking arm 56 is coupled to a receiving end 72 of the second locking arm 58 so as to form a living hinge. In one example, the receiving end 62 and the receiving end 72 of the second locking arm 58 are coupled together through forming, such as injection molding, however, the receiving end 62 and receiving end 72 can be coupled through any suitable technique.

The second locking arm 58 includes a locking end 74 and the receiving end 72. The locking end 74 engages a portion of the female connector portion 14 to couple the male connector portion 12 to the female connector portion 14. The locking end 74 is substantially arcuate or rounded, however, the locking end 74 can have any desired shape to engage the female connector portion 14. The receiving end 72 defines an aperture 76. The aperture 76 is semi-circular to engage the pin 70 of the female connector portion 14. Generally, the aperture 76 is vertically offset relative to the aperture 68 of the first locking arm 56 to facilitate engagement of the first locking arm 56 and the second locking arm 58 with the pin 70. While the aperture 76 is illustrated herein as being semi-circular and the pin 70 as cylindrical, the aperture 68, aperture 76 and the pin 70 can have any desired cooperating shape.

Figure 6:
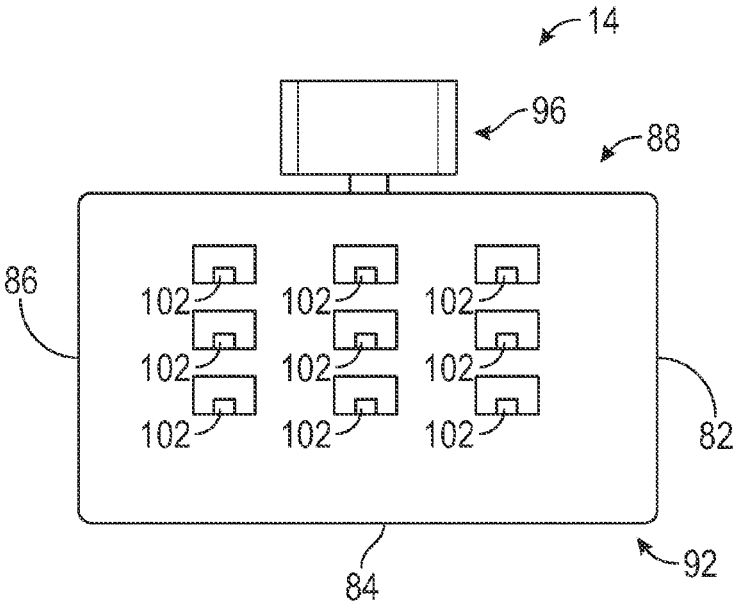
FIG. 6 is an end view of a female connector portion of the electrical connector system of FIG. 2.

With continued reference to FIG. 2, and with additional reference to FIGS. 4 and 6, the female connector portion 14 includes a housing 80. In one example, the housing 80 can be substantially rectangular, however, the housing 80 can have any desired shape that cooperates with the housing 18 of the male connector portion 12. The housing 80 includes a first side 82, a second side 84, a third side 86 and a fourth side 88. The first side 82, second side 84, third side 86 and fourth side 88 cooperate to define a cavity 89 (FIG. 4). The housing 18 also includes a first end 90 and a second end 92. In one example, the housing 80 is composed of a polymeric material.

As best shown in FIG. 6, the first side 82 is generally opposite the third side 86. The first side 82 and the third side 86 are substantially planar. The second side 84 is generally opposite the fourth side 88. The second side 84 is substantially planar. The fourth side 88 includes at least one channel 94, at least one lock receptacle 96 and the pin 70. The pin 70 extends outwardly or away from the fourth side 88, and extends in a direction substantially perpendicular to the fourth side 88. Generally, the pin 70 extends for a distance to enable both the first locking arm 56 and the second locking arm 58 to engage the pin 70.

In one example, the at least one channel 94 comprises a plurality of channels 94, which are defined through the fourth side 88, and extend from the first end 90 to near the second end 92. The channels 94 receive the guides 36 of the male connector portion 12 to assist in aligning the male connector portion 12 with the female connector portion 14. In one example, the at least one lock receptacle 96 comprises a first lock receptacle 98 and a second lock receptacle 100. The first lock receptacle 98 and the second lock receptacle 100 each extend outwardly or away from the fourth side 88 to enable engagement of the first locking arm 56 and the second locking arm 58 with the first lock receptacle 98 and the second lock receptacle 100. The first lock receptacle 98 and the second lock receptacle 100 can be substantially mirror images of each other about the longitudinal axis 15. The first lock receptacle 98 comprises any suitable protuberance that engages the locking end 60 of the first locking arm 56. For example, the first lock receptacle 98 comprises a hook shaped end that hooks into engagement with the locking end 60 of the first locking arm 56. The engagement between the first lock receptacle 98 and the locking end 60 can create audible feedback, if desired.

Similar to the first lock receptacle 98, the second lock receptacle 100 comprises any suitable protuberance that engages the locking end 74 of the second locking arm 58. For example, the second lock receptacle 100 comprises a hook shaped end that hooks into engagement with the locking end 74 of the second locking arm 58. The engagement between the second lock receptacle 100 and the locking end 74 can create audible feedback, if desired.

Figure 7:
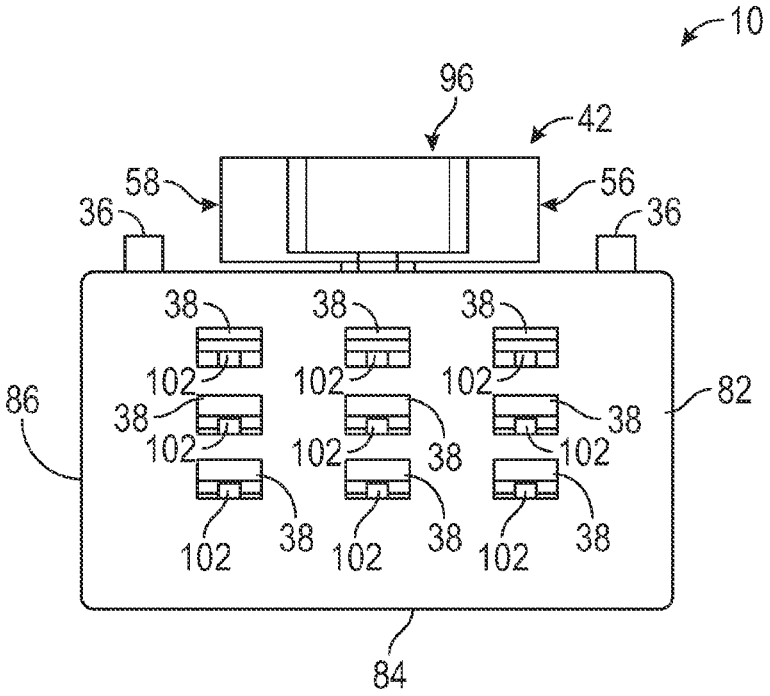
FIG. 7 is an end view of the electrical connector system of FIG. 2.

The cavity 89 is generally defined through the housing 80 from the first end 90 to the second end 92. The cavity 89 enables the male connector portion 12 to be received within the housing 80. In one example, the second end 92 defines at least one or a plurality of contacts, such as pins 102 (FIGS. 1 and 6), which are coupled to respective conductors 103. With reference to FIGS. 1 and 7, the pins 102 electrically engage the one or more contacts 38 of the male connector portion 12 to facilitate an electrical connection between the male connector portion 12 and the female connector portion 14 when the male connector portion 12 is coupled and secured to the female connector portion 14.

Figure 10:
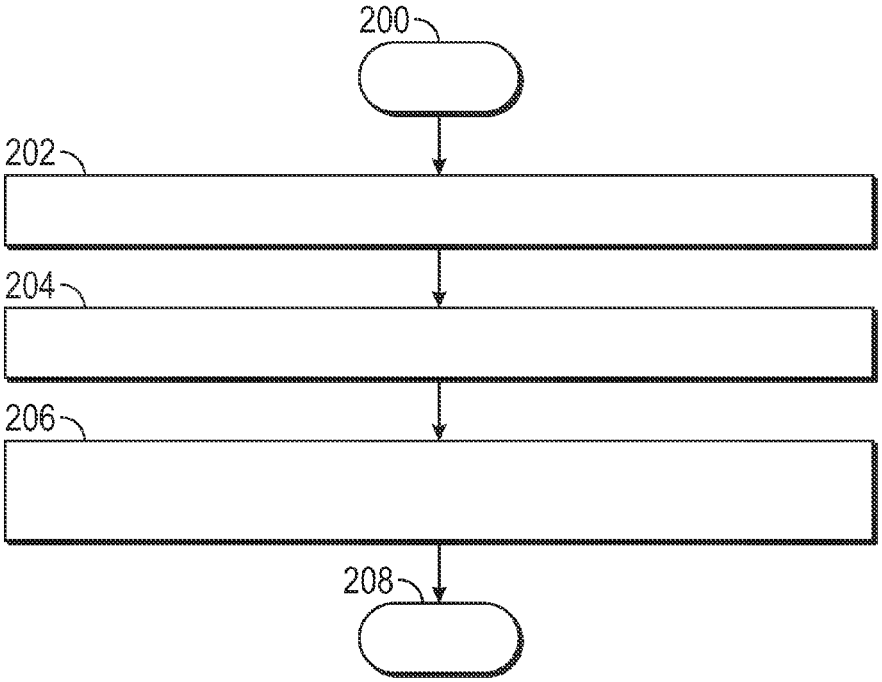
FIG. 10 is a flowchart illustrating a method of assembly the electrical connector system of FIG. 2.

In one example, with reference to FIG. 10, a method of assembling the male connector portion 12 to the female connector portion 14 starts at 200. As can be appreciated in light of the disclosure, the order of operation within the method is not limited to the sequential execution as illustrated in FIG. 10, but may be performed in one or more varying orders as applicable and in accordance with the present disclosure.

Figure 8:
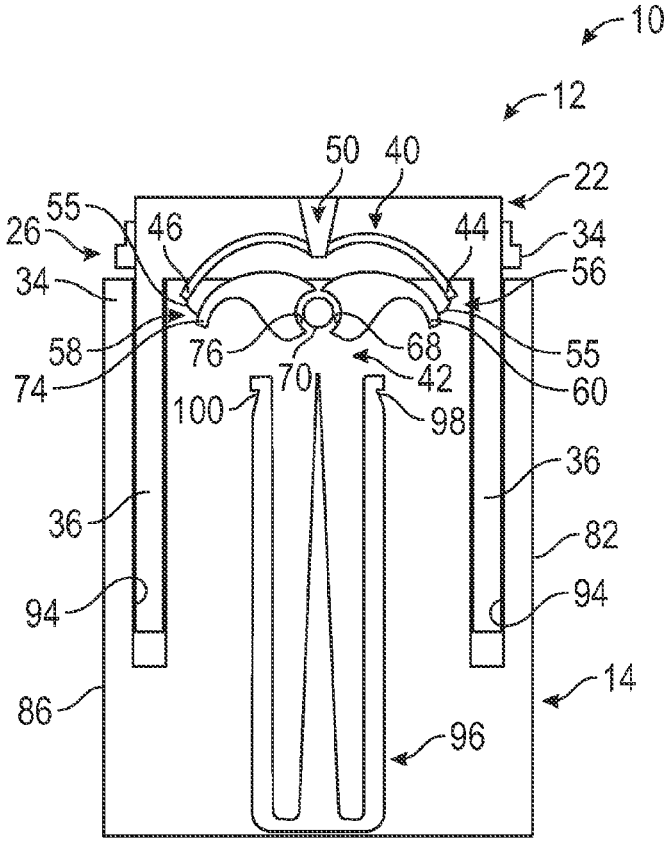
FIG. 8 is a front view of the electrical connector system of FIG. 2, in which the locking system of the male connector portion is at a peak position.

At 202, the male connector portion 12 is aligned with the cavity 89 of the female connector portion 14. At 204, a force is applied to one or more of the male connector portion 12 and the female connector portion 14. The application of the force causes the biasing member 40 of the locking system 20 to begin to move from the first position (FIG. 5) to the center or peak position (FIG. 8). As the biasing member 40 begins to move from the first position (FIG. 5) to the center or peak position (FIG. 8), the first locking arm 56 and the second locking arm 58 move due to the web 55 that interconnects the first locking arm 56 and the second locking arm 58 with the first end 44 and the second end 46 of the biasing member 40. Generally, the application of the force increases as the biasing member 40 is moved closer to the center or peak position (FIG. 8). The force applied to the biasing member 40 is stored in the biasing member 40 as potential energy.

At 206, once the force applied to the biasing member 40 has moved the biasing member 40 over center or over the peak position, the biasing member 40 substantially automatically moves into the second position, such that the locking system 20 is self-closing. In other words, once the biasing member 40 has been moved over the center or peak position, the potential energy stored by the biasing member 40 is converted into kinetic energy, which is used to move the biasing member 40 into the second position. The substantially automatic movement of the biasing member 40 into the second position provides a tactile feedback to the operator, as the force input required for the male connector portion 12 greatly diminishes. Further, the movement of the biasing member 40 into the second position moves the first locking arm 56 and second locking arm 58, causing the first locking arm 56 and the second locking arm 58 to pivot and engage the pin 70. Thus, the movement of the biasing member 40 into the second position electrically couples and secures the male connector portion 12 to the female connector portion 14 and the method ends at 208.

Figure 11:
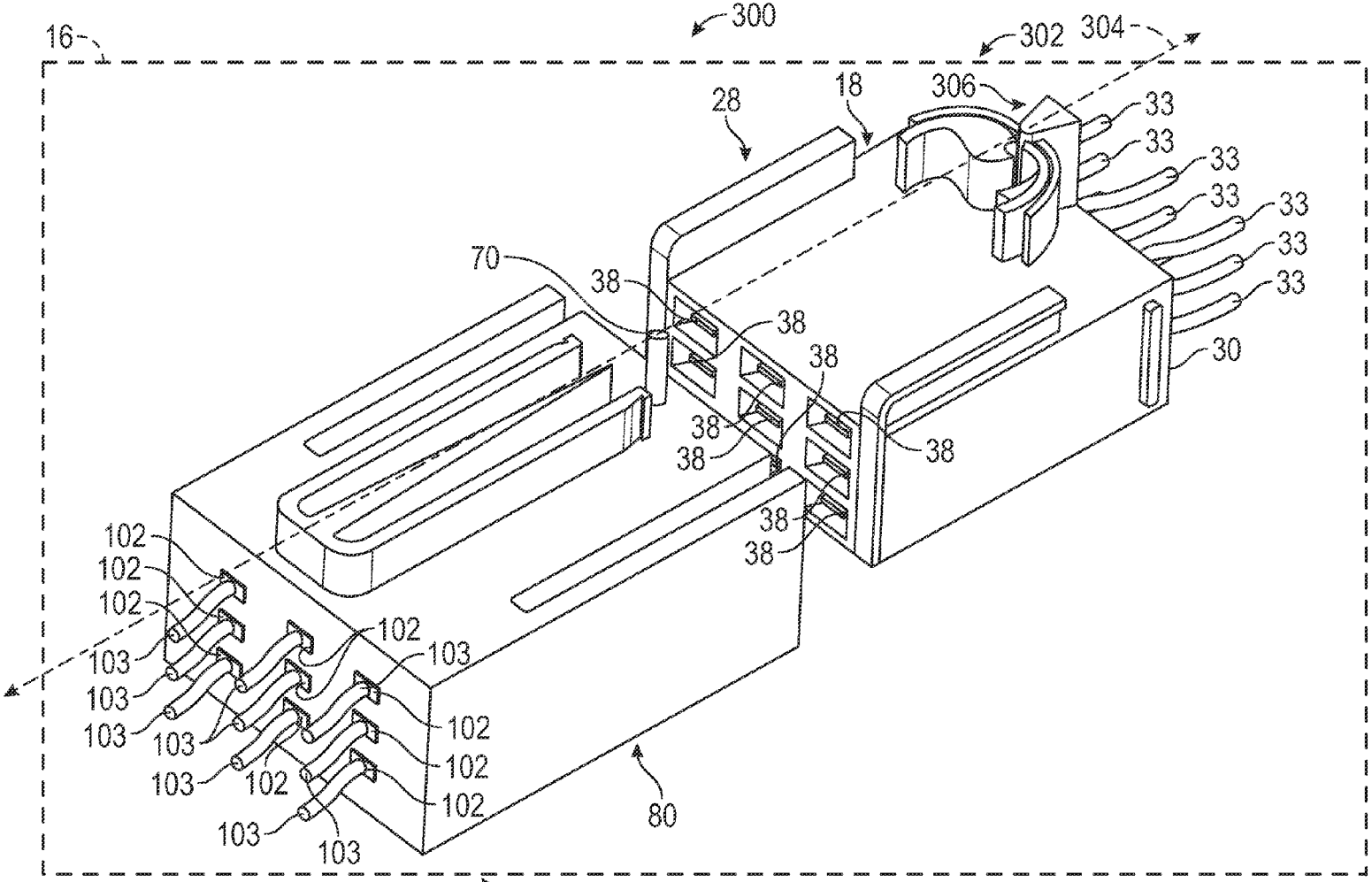
FIG. 11 is an exploded perspective view illustrating an electrical connector system in accordance with the various teachings of the present disclosure, in which the locking system of the male connector portion is in the second position.
Figure 12:
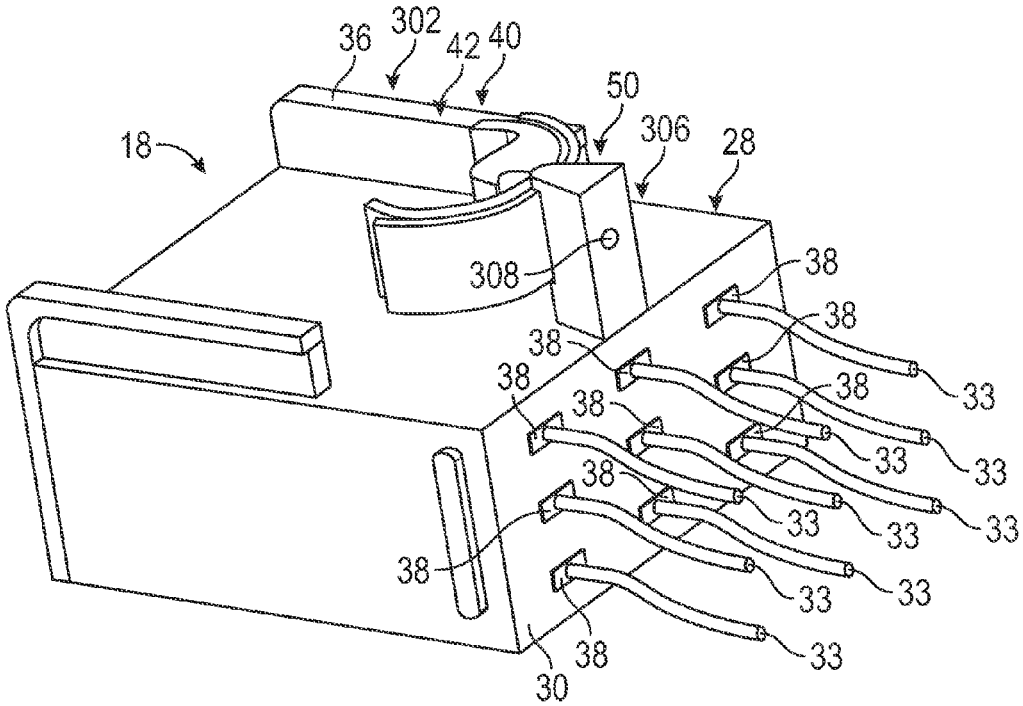
FIG. 12 is a perspective view of a male connector portion of the electrical connector system of FIG. 11.

With reference to FIGS. 11 and 12, an electrical connector system 300 is shown. As the electrical connector system 300 can be similar to the electrical connector system 10 described with regard to FIGS. 1-10, the same reference numerals will be used to denote the same or similar items as those in FIGS. 1-10 and for the sake of brevity, these items will not be described again in great detail herein. The electrical connector system 300 includes a first or male connector portion 302 and the second or female connector portion 14, which can each extend along a longitudinal axis 304. The male connector portion 302 and the female connector portion 14 can be used to electrically interconnect any suitable electrical device, component or wiring as known to those skilled in the art. As a further example, the electrical connector system 300 can be used on the vehicle 16, such as a motor vehicle, to interconnect one or more electrical devices.

With continued reference to FIG. 11, and with additional reference to FIG. 12, the male connector portion 302 includes the housing 18 and a locking system 306. The locking system 306 is coupled to the fourth side 28 at the first end 30 of the housing 18. The locking system 306 is coupled to the fourth side 28 so as to extend outwardly or away from the fourth side 28. Generally, the locking system 306 extends outwardly for a greater distance than the guides 36, as illustrated in FIG. 12.

The locking system 306 comprises a self-closing locking system, which provides an operator assembling the male connector portion 302 with the female connector portion 14 a tactile feedback that the male connector portion 302 is coupled, locked or secured, and electrically connected to the female connector portion 14. In one example, with reference to FIG. 12, the locking system 306 includes the at least one biasing member 40, the at least one locking arm 42 and a reset 308. In this example, the locking system 306 includes the single biasing member 40, however, the biasing member 40 can be composed of two separate and discrete biasing members, if desired.

Figure 13:
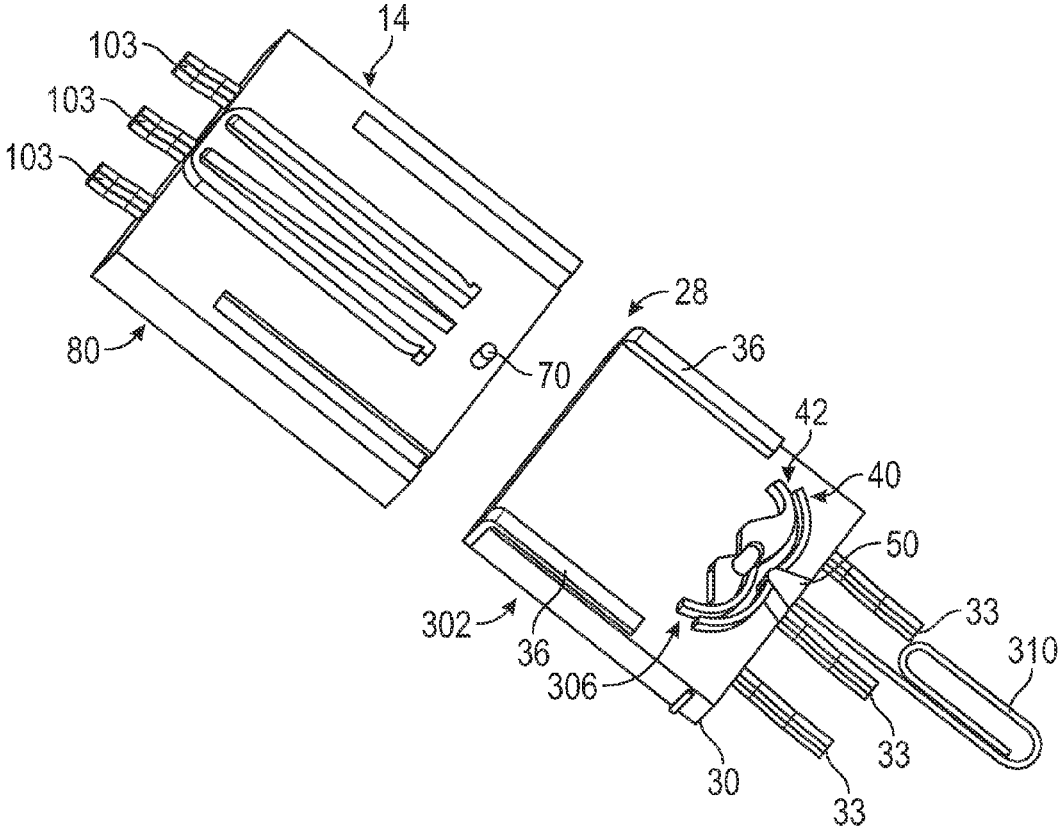
FIG. 13 is an exploded perspective view of the electrical connector system of FIG. 11, in which the locking system of the male connector portion has been reset to the first position.

With reference to FIG. 12, the reset 308 enables manual movement of the at least one biasing member 40 of the locking system 306 from the second position to the first position. In one example, the reset 308 is defined through the post 50. In this example, with reference to FIGS. 12 and 13, the reset 308 comprises a bore defined through the post 50, which is sized to enable the receipt of a mechanical device, such as a small cylindrical device, for example, a small diameter metal wire 310 (FIG. 13), to enable the manual application of force to the at least one locking arm 42. In one example, the small diameter metal wire 310 is a paperclip. The manual application of force to the at least one locking arm 42 allows an operator to move the at least one biasing member 40 of the locking system 306 from the second position to the first position, thereby resetting the position of the at least one biasing member 40. The ability to reset the locking system 306 can be desirable in instances where the at least one biasing member 40 has accidently moved from the first position to the second position prior to an initial connection with the female connector portion 14, for example, during handling or shipping.

As the method of assembling the male connector portion 302 to the female connector portion 14 can be substantially similar to the method described with regard to FIG. 10, the method will not be discussed in great detail herein. Briefly, however, in order to reset the locking system 306 of the male connector portion 302, the small diameter metal wire 310 (FIG. 13) is inserted into the reset 308 and through the post 50 so that the small diameter metal wire 310 contacts the at least one locking arm 42. The continued advancement or insertion of the small diameter metal wire 310 through the reset 308 causes the at least one locking arm 42 to move, thereby causing the at least one biasing member 40 to move from the second position to the first position. The movement of the at least one biasing member 40 into the first position resets the locking system 306 for engagement with the female connector portion 14.

Figure 14:
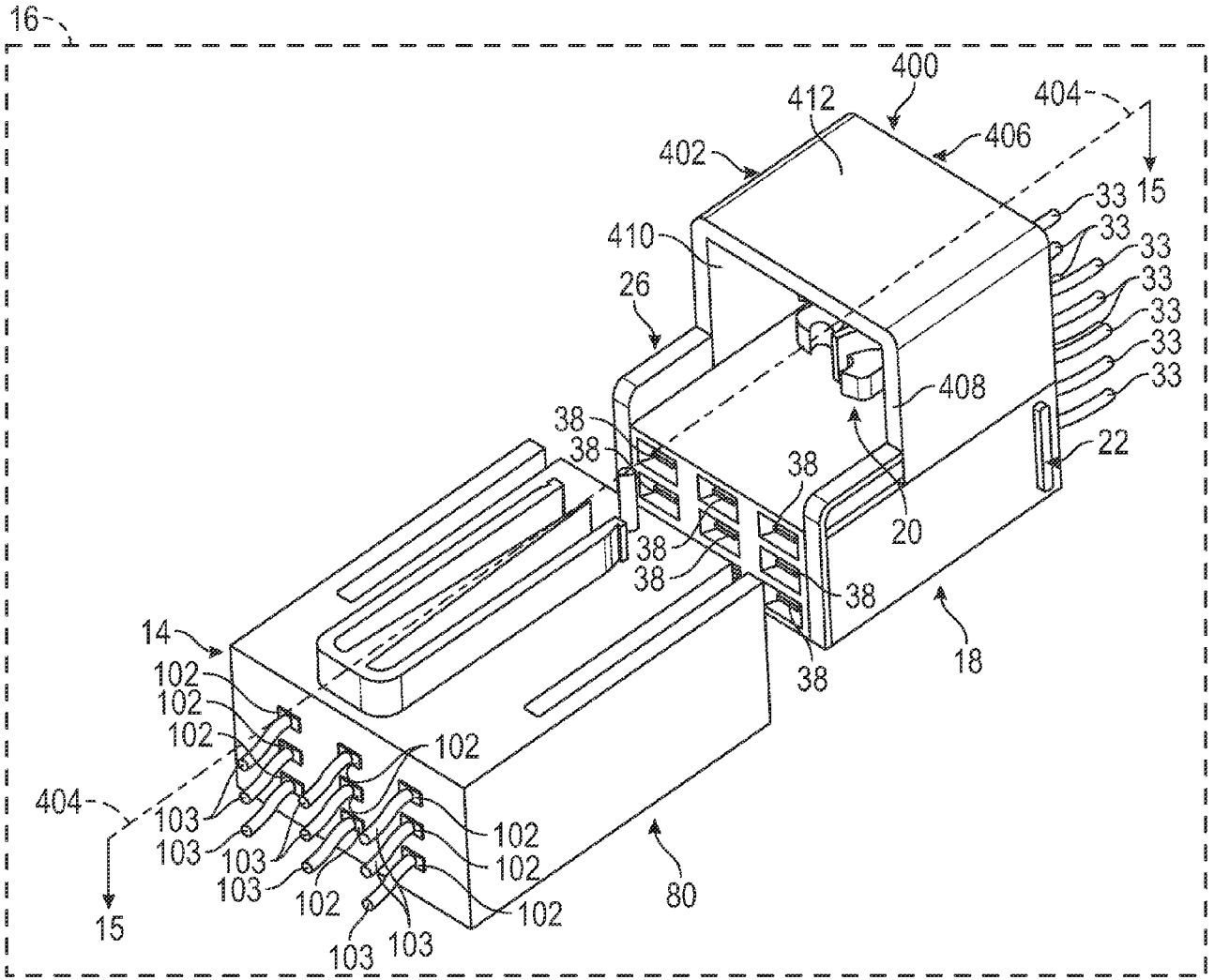
FIG. 14 is an exploded perspective view illustrating an electrical connector system in accordance with the various teachings of the present disclosure.
Figure 15:
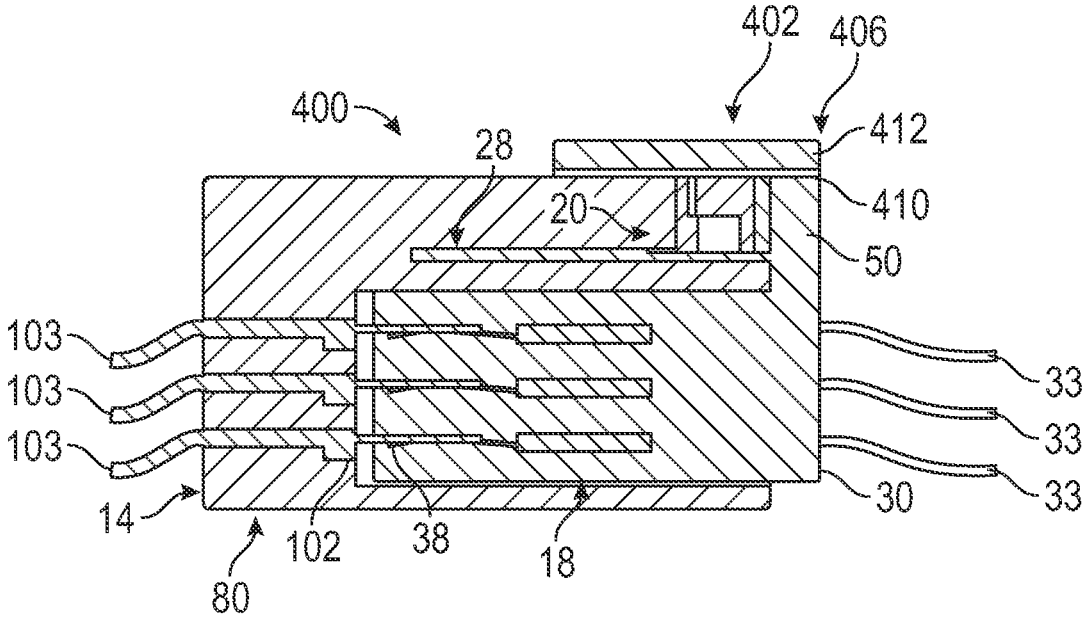
FIG. 15 is cross-sectional view of the electrical connector system of FIG. 14, taken along line 15-15 of FIG. 14.

With reference to FIGS. 14 and 15, an electrical connector system 400 is shown. As the electrical connector system 400 can be similar to the electrical connector system 10 described with regard to FIGS. 1-10, the same reference numerals will be used to denote the same or similar items, and for the sake of brevity, these items will not be described again in great detail herein. The electrical connector system 400 includes a first or male connector portion 402 and the second or female connector portion 14, which can each extend along a longitudinal axis 404. The male connector portion 402 and the female connector portion 14 can be used to electrically interconnect any suitable electrical device, component or wiring as known to those skilled in the art. As a further example, the electrical connector system 400 can be used on the vehicle 16, such as a motor vehicle, to interconnect one or more electrical devices.

With continued reference to FIG. 14, and with additional reference to FIG. 15, the male connector portion 402 includes the housing 18, the locking system 20 and a lock shield 406. The locking system 20 is coupled to the housing 18 and provides an operator assembling the male connector portion 402 with the female connector portion 14 a tactile feedback that the male connector portion 402 is coupled, locked or secured, and electrically connected to the female connector portion 14.

The lock shield 406 is coupled to the fourth side 28 at the first end 30 of the housing 18 so as to be disposed over the locking system 20 and adjacent to the guides 36. The lock shield 406 can be fixedly coupled to the housing 18 through any suitable technique, such as ultrasonic welding, adhesives, etc. The lock shield 406 protects the locking system 20 from inadvertent movement between the first position and the second position. In one example, the lock shield 406 is substantially U-shaped, and is sized to extend from the first side 22 of the housing 18 to the third side 26 of the housing 18. In one example, the lock shield 406 has a first arm 408 coupled to the first side 22 and a second arm 410 coupled to the third side 26. The first arm 408 and second arm 410 extend outwardly from a base 412. Generally, the first arm 408 and second arm 410 have a sufficient length such that the locking system 20 can move between the first position and the second position without contacting the lock shield 406, as illustrated in FIG. 15. The base 412 is sized with a width substantially equal to a width of the fourth side 28 such that the first arm 408 is flush with the first side 22 and the second arm 410 is flush with the third side 26 when the lock shield 406 is coupled to the housing 18.

As the method of assembling the male connector portion 402 to the female connector portion 14 can be substantially similar to the method described with regard to FIG. 10, the method will not be discussed in great detail herein. Briefly, however, with the lock shield 406 coupled to the housing 18, the locking system 20 is protected as it moves between the first position and the second position.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An electrical connector system, comprising:

a first electrical connector portion;

a second electrical connector portion defining a cavity to receive the first electrical connector portion; and a locking system coupled to the first electrical connector portion, the locking system including a biasing member and at least one locking arm, the biasing member coupled to the at least one locking arm and the biasing member movable from a first position to a second position, the at least one locking arm comprising a first locking arm and a second locking arm, and the first locking arm is coupled to a first end of the biasing member and the second locking arm is coupled to a second end of the biasing member, wherein a force required to move the biasing member from the first position to the second position changes as the biasing member moves from the first position to the second position, the first locking arm and the second locking arm each include a locking end and a receiving end, and the first locking arm and the second locking arm are coupled together at the receiving end to form a living hinge.

2. The electrical connector system of claim 1, wherein the biasing member has a peak position between the first position and the second position, and the force required to move the biasing member from the first position to the peak position is different than a force required to move the biasing member from the peak position to the second position.

3. The electrical connector system of claim 2, wherein the biasing member moves automatically from the peak position to the second position.

4. The electrical connector system of claim 1, wherein the second connector portion comprises a first lock receptacle spaced apart from a second lock receptacle, the locking end of the first locking arm engages the first lock receptacle and the locking end of the second locking arm engages the second lock receptacle with the biasing member in the second position.

5. The electrical connector system of claim 1, wherein the force to move the biasing member from the first position to the second position provides a tactile feedback.

6. The electrical connector system of claim 1, wherein the receiving ends of the first locking arm and the second locking arm define an aperture, and the aperture of the first locking arm and the second locking arm cooperate to engage a pin of the second electrical connector portion to couple the first electrical connector portion to the second electrical connector portion.

7. An electrical connector system, comprising:

a first electrical connector portion having a first side;

a second electrical connector portion defining a cavity to receive the first electrical connector portion, the second electrical connector portion including a second side, with a pin extending outwardly from the second side; and a locking system coupled to the first side of the first electrical connector portion, the locking system including a biasing member and at least one locking arm, the biasing member coupled to the at least one locking arm and the biasing member movable from a first position to a second position, wherein the movement of the biasing member from the first position to the second position engages the at least one locking arm with the pin of the second electrical connector portion to electrically couple the first electrical connector portion to the second electrical connector portion, the at least one locking arm comprises a first locking arm and a second locking arm, and each of the first locking arm and the second locking arm define an aperture to engage the pin of the second electrical connector portion.

8. The electrical connector system of claim 7, wherein a force required to move the biasing member from the first position to the second position changes as the biasing member moves from the first position to the second position.

9. The electrical connector system of claim 7, wherein the biasing member has a peak position between the first position and the second position, and the force required to move the biasing member from the first position to the peak position is different than a force required to move the biasing member from the peak position to the second position.

10. The electrical connector system of claim 9, wherein the biasing member moves automatically from the peak position to the second position.

11. The electrical connector system of claim 7, wherein the aperture of the first locking arm and the second locking arm are defined at a respective receiving end of the first locking arm and the second locking arm.

12. The electrical connector system of claim 11, wherein the receiving end of the first locking arm is coupled to the receiving end of the second locking arm to form a living hinge.

13. The electrical connector system of claim 7, wherein the first locking arm is coupled to a first end of the biasing member and the second locking arm is coupled to a second end of the biasing member.

14. The electrical connector system of claim 7, wherein the movement of the biasing member from the first position to the second position provides a tactile feedback.

15. An electrical connector system, comprising:

a first electrical connector portion having a first side;

a second electrical connector portion defining a cavity to receive the first electrical connector portion, the second electrical connector portion including a second side, with a pin extending outwardly from the second side;

a locking system coupled to the first side of the first electrical connector portion, the locking system including a biasing member, a first locking arm and a second locking arm, the biasing member coupled to the first locking arm and the second locking arm, and the biasing member movable from a first position to a second position, with the biasing member having a peak position between the first position and the second position, wherein the movement of the biasing member from the first position to the peak position requires a first force, and the movement of the biasing member from the peak position to the second position requires a second force, the second force different than the first force, and the movement of the biasing member from the peak position to the second position engages the first locking arm and the second locking arm with the pin of the second electrical connector portion to electrically couple the first electrical connector portion to the second electrical connector portion.

16. The electrical connector system of claim 15, wherein the movement of the biasing member from the peak position to the second position provides a tactile feedback.

17. The electrical connector system of claim 15, wherein the first locking arm and the second locking arm each include a locking end and a receiving end, the first locking arm and the second locking arm are coupled together at the receiving end to form a living hinge and the receiving end of the first locking arm and the receiving end of the second locking arm engage the pin of the second electrical connector portion.

* * * * *